US012274928B2

(12) United States Patent
Grou

(10) Patent No.: US 12,274,928 B2
(45) Date of Patent: Apr. 15, 2025

(54) REBOUND WALL

(71) Applicant: 9297-5531 Quebec Inc., Blainville (CA)

(72) Inventor: Jean-Francois Grou, Blainville (CA)

(73) Assignee: 9297-5531 Quebec Inc., Blainville (CA)

( * ) Notice: Subject to any disclaimer, the term of this patent is extended or adjusted under 35 U.S.C. 154(b) by 437 days.

(21) Appl. No.: 14/899,806

(22) PCT Filed: Jun. 20, 2014

(86) PCT No.: PCT/CA2014/000513
§ 371 (c)(1),
(2) Date: Dec. 18, 2015

(87) PCT Pub. No.: WO2014/201550
PCT Pub. Date: Dec. 24, 2014

(65) Prior Publication Data

US 2016/0136497 A1 May 19, 2016

Related U.S. Application Data

(60) Provisional application No. 61/837,897, filed on Jun. 21, 2013.

(51) Int. Cl.
*A63B 69/00* (2006.01)
*A63B 69/38* (2006.01)
(Continued)

(52) U.S. Cl.
CPC ..... *A63B 69/0097* (2013.01); *A63B 69/0053* (2013.01); *A63C 19/08* (2013.01);
(Continued)

(58) Field of Classification Search
CPC . A63B 69/0097; A63B 69/0071; A63B 69/38; A63B 69/0053; A63B 63/00;
(Continued)

(56) References Cited

U.S. PATENT DOCUMENTS 1,623,284 A * 4/1927 Stoddart ..... A63F 7/305
273/127 R
2,104,375 A * 1/1938 Perry ..... A63F 9/0402
273/148 R
(Continued)

FOREIGN PATENT DOCUMENTS

BE 903606 A 3/1986
DE 2916262 A1 * 10/1980 ..... A63B 69/0097
(Continued)

OTHER PUBLICATIONS https://dialog.proquest.com/professional/patents/docview/1131811931/16B5BD290082B1D6288/1?accountid=161361#/eng_1 English translation for DE2916262.*
(Continued)

*Primary Examiner* — Melba Bumgarner
*Assistant Examiner* — Amir A Klayman
(74) *Attorney, Agent, or Firm* — Taft Stettinius & Hollister LLP

(57) ABSTRACT

There is described a rebound wall to be positioned with respect to a playing surface having an activity area and configured for varying a rebound of a ball directed thereon, the rebound wall comprising: a wall having a rebound surface and adapted to be positioned vertically relative to the playing surface so that the rebound surface substantially faces the activity area; the rebound surface comprising a plurality of impact zones each for returning the ball according to a respective type of shot, each impact zone comprising at least one rebound region each for rebounding the ball along a respective rebound direction towards the activity area upon the ball impacting thereon, each rebound region being shaped as a function of the respective rebound direction the type of shot of the respective impact zone in which the rebound region is contained.

19 Claims, 6 Drawing Sheets

(51) Int. Cl.
*A63B 102/02* (2015.01)
*A63C 19/08* (2006.01)

(52) U.S. Cl.
CPC ..... *A63B 69/38* (2013.01); *A63B 2102/02* (2015.10); *A63B 2208/0204* (2013.01)

(58) Field of Classification Search
CPC ..... A63B 2063/001; A63B 2012/16; A63B 2012/02; A63B 2208/0204; A63C 19/08
See application file for complete search history.

(56) References Cited

U.S. PATENT DOCUMENTS 2,614,839 A * 10/1952 Forsyth ..... A63B 69/0097 108/1
3,001,790 A * 9/1961 Pratt ..... A63B 69/0097 473/434
3,088,735 A 5/1963 Clark
3,128,627 A * 4/1964 Harris ..... A63B 63/00 473/164
3,180,643 A 4/1965 Kallai
3,215,432 A 11/1965 Lee et al.
3,427,026 A 2/1969 Mahoney
3,456,945 A 7/1969 Epply
3,591,184 A * 7/1971 Conklin ..... A63B 24/0021 473/155
3,643,959 A * 2/1972 Cornell ..... A63B 24/0021 473/152
3,692,307 A * 9/1972 Henry ..... A63B 69/0097 473/435
3,697,068 A 10/1972 McDougall
3,837,655 A * 9/1974 Angelos ..... G01P 3/00 473/152
3,893,275 A * 7/1975 Omholt ..... E04F 13/0885 52/309.5
3,910,574 A * 10/1975 Voltz ..... A63B 63/083 473/449
3,918,711 A 11/1975 Zak
3,968,967 A 7/1976 Nally
3,989,246 A 11/1976 Brown et al.
4,026,551 A * 5/1977 Larson ..... A63B 69/0097 273/127 R
4,070,018 A 1/1978 Hodges
4,082,271 A 4/1978 Martin
4,093,218 A 6/1978 Burchers
4,116,437 A 9/1978 Johnson
4,134,585 A * 1/1979 Semon ..... A63B 69/0097 473/434
4,140,313 A 2/1979 Martin
4,183,524 A 1/1980 Kifferstein et al.
4,309,032 A * 1/1982 Facius ..... A63B 69/0097 273/376
4,333,646 A * 6/1982 Pfeilsticker ..... A63B 24/0003 473/435
D265,413 S 7/1982 Millikan
4,373,720 A 2/1983 Lombardi et al.
4,421,318 A 12/1983 Sverdlik et al.
4,456,251 A 6/1984 Balaz
4,456,252 A 6/1984 Hartland
4,491,321 A 1/1985 Veenema
4,568,089 A 2/1986 Jenkins et al.
4,588,190 A 5/1986 Stewart et al.
4,718,668 A 1/1988 Schipske
4,807,879 A * 2/1989 Eliot ..... A63B 63/00 273/378
5,004,235 A * 4/1991 Suga ..... A63C 19/00 473/415
5,133,548 A * 7/1992 Bedord, II ..... A63B 63/00 273/410
5,354,051 A 10/1994 Fehrenbach et al.
5,575,471 A * 11/1996 Robinson ..... A63B 67/04 473/475
5,795,252 A * 8/1998 Crucet ..... A63B 71/022 473/434
5,833,234 A 11/1998 Vavala et al.
5,857,679 A 1/1999 Ringe et al.
5,902,194 A * 5/1999 Wade ..... A63B 63/00 273/400
5,935,024 A 8/1999 Lao
6,010,414 A 1/2000 Snow
6,135,456 A * 10/2000 Cooper ..... A63B 63/00 273/348
6,213,900 B1 4/2001 Steyn et al.
6,357,750 B1 * 3/2002 Lievens ..... A63B 69/0097 273/395
6,508,729 B1 * 1/2003 Coltrane ..... A63B 63/00 273/402
6,585,610 B2 7/2003 Sompolinsky
7,056,239 B2 6/2006 Hickman, Jr.
7,249,767 B1 * 7/2007 Gorton ..... A63B 69/0097 273/396
7,677,993 B2 3/2010 McTavish
7,909,330 B2 3/2011 Domjen
8,016,711 B2 9/2011 Phillips et al.
8,226,070 B2 7/2012 Froud
2003/0013561 A1 * 1/2003 Sompolinsky ..... A63B 67/002 473/435
2005/0049088 A1 3/2005 Chang et al.
2008/0258394 A1 * 10/2008 Allingham ..... A63B 69/0097 273/407
2009/0069125 A1 * 3/2009 Porter ..... A63B 69/0097 473/435
2010/0016101 A1 * 1/2010 Domjen ..... A63B 69/002 473/435
2012/0190485 A1 7/2012 Aurbach
2013/0130759 A1 * 5/2013 Boi ..... A63F 13/46 463/2
2014/0171230 A1 * 6/2014 Candello ..... A63B 69/0002 473/456

FOREIGN PATENT DOCUMENTS

DE 20305646 U1 8/2003
EP 0045346 A1 2/1982
EP 0083316 A1 7/1983
EP 0211390 A1 2/1987
EP 0241211 A2 10/1987
EP 0319045 A2 6/1989
FR 2644073 A1 9/1990
FR 2725139 A1 4/1996
GB 1220057 5/1967
GB 2466012 A 6/2010
JP 2000176066 A * 6/2000
WO 84/00497 A1 2/1984
WO 97/34664 A1 9/1997

OTHER PUBLICATIONS

International Search Report; Canadian Intellectual Property Office; International Application No. PCT/CA2014/000513; Sep. 11, 2014; 3 pages.
Written Opinion of the International Searching Authority; Canadian Intellectual Property Office; International Application No. PCT/CA2014/000513; Sep. 11, 2014; 4 pages.
SKLZ Shockwave Pitchback & Random Rebounder; Apr. 29, 2014; http://www.kmart.com/sklz-shockwave-8482-pitchback-random-rebound/p-080V005891 . . . ; 2 pages.

* cited by examiner

REBOUND WALL

CROSS-REFERENCE TO RELATED APPLICATIONS

This application is a U.S. national stage filing under 35 U.S.C. § 371 of International Application No. PCT/CA2014/000513 filed on Jun. 20, 2014, which claims priority the benefit of U.S. Provisional patent application Ser. No. 61/837,897, which was filed on Jun. 21, 2013, the entire contents of each of these applications hereby incorporated by reference.

TECHNICAL FIELD

The present invention relates to the field of rebound walls, and more particularly, to a rebound wall adapted to vary a rebound of a ball directed against the wall.

BACKGROUND

Practice walls are known in the art. Taking the sport of tennis as one example, it is known to install or set-up a practice wall. Once installed or set-up, a player, either alone or with others, can hit a tennis ball against the practice wall such that the ball will be returned to her/him. This enables the player to practice her/his play, and it is hoped, improve her/his game.

At least some of the conventional walls may have some of the following disadvantages: a) they can be planar surfaces which force the player to hit the ball towards the wall at predictable angles to ensure that the ball will be returned back to the player; b) they may be difficult to install against/with existing installations; c) they may not be suitable for players having intermediate or advanced skill levels; d) they may not introduce sufficient variety in the return of the ball, which results in players of any significant skill level quickly becoming accustomed to the returns generated by the wall and thus creating the habit of "playing to the wall" and even instilling boredom reducing the length of training; e) they may not be suitable to use with more than one player, such as "doubles" in tennis, for example; etc.

Hence, in light of the aforementioned, there is a need for a system which, by virtue of its design and components, would be able to overcome or at least minimize some of the aforementioned prior art problems.

SUMMARY

One object of the present invention is to provide a rebound wall, which by virtue of its design and components, satisfies some of the above-mentioned needs.

According to a first broad aspect, there is provided a rebound wall to be positioned with respect to a playing surface having an activity area and configured for varying a rebound of a ball directed thereon, the rebound wall comprising: a wall having a rebound surface and adapted to be positioned vertically relative to the playing surface so that the rebound surface substantially faces the activity area; the rebound surface comprising a plurality of impact zones each for returning the ball according to a respective type of shot, each impact zone comprising at least one rebound region each for rebounding the ball along a respective rebound direction towards the activity area upon the ball impacting thereon, each rebound region being shaped as a function of the respective rebound direction and the type of shot of the respective impact zone in which the rebound region is contained.

In one embodiment, the type of shot for each impact zone is chosen as a function of the position of the impact zone within the rebound surface.

In one embodiment, at least one rebound region comprises at least one planar region.

In one embodiment, at least one rebound region comprises at least one curved region each comprising at least one of a valley and a land.

In one embodiment, the rebound wall further comprises at least one backstop positioned adjacent to the wall.

In one embodiment, the rebound surface is designed for rebounding a tennis ball.

In one embodiment, the respective shot comprises one of: a serve, a forehand shot, a backhand shot, a groundstroke, a volley, a swing, a drop volley, a drive volley, a flat shot, a topspin, a backspin, a smash, a drop shot, a lob, a moon volley, a passing shot, and a down-the-line shot.

In another embodiment, the rebound surface is configured for rebounding a soccer ball.

In another embodiment, the respective shot comprises one of: an instep drive, a swerve shot, a chip shot or a lob, and a knuckleball.

According to a second broad aspect, there is provided a rebound wall to be positioned with respect to a court having an activity area and configured for varying a rebound of a ball directed thereon, the rebound wall comprising: a plurality of contiguous impact zones dispersed horizontally between opposed side ends of the rebound wall and vertically between a top end and a bottom end of the rebound wall, thereby forming a continuous return surface, each impact zone comprising at least one rebound face for rebounding the ball along a rebound direction towards the activity area upon the ball impacting the rebound face, each rebound face being positioned, shaped, and sized such that the rebound direction of the ball impacting thereon differs from the rebound direction of the ball impacting at least one adjacent rebound face.

In one embodiment, the rebound wall comprises upper segments and lower segments, the impact zones of the upper segments being configured for rebounding the ball in a downward rebound direction, and the impact zones of the lower segments being configured for rebounding the ball in an upward rebound direction.

In one embodiment, the rebound wall comprises a center segment, left segments, and right segments, the impact zones of the center segment configured for rebounding the ball towards the activity area along any rebound direction, the impact zones of the left and right segments configured for rebounding the ball towards the activity area.

In one embodiment, at least some of the rebound faces are made of a non-reflective material.

In one embodiment, at least some of the rebound faces are made of a material configured for rebounding the ball with a spin.

In one embodiment, at least some of the rebound faces are planar.

In one embodiment, at least some of the rebound faces are curved.

In one embodiment, the rebound wall further comprises at least one backstop positioned adjacent to the continuous return surface.

In one embodiment, at least one of the impact zones is removable from the wall.

According to another broad aspect, there is provided a playing area comprising the above-described rebound wall.

According to still another broad aspect, there is provided a method for designing a rebound surface of a rebound wall, the rebound wall adapted to be positioned relative to a playing surface having an activity area and configured for varying a rebound of a ball directed thereon, comprising: dividing the rebound surface into a plurality of impact zones each for returning the ball according to a respective type of shot; dividing each impact zone into at least one rebound region each having a front surface for rebounding the ball along a respective rebound direction towards the activity area upon the ball impacting thereon; and for each rebound region, determining a shape of the respective front surface as a function of the respective rebound direction and the type of shot associated with the respective impact zone in which the rebound region is contained.

BRIEF DESCRIPTION OF THE DRAWINGS

Further features and advantages of the present invention will become apparent from the following detailed description, taken in combination with the appended drawings, in which.

DETAILED DESCRIPTION

Figure 1:
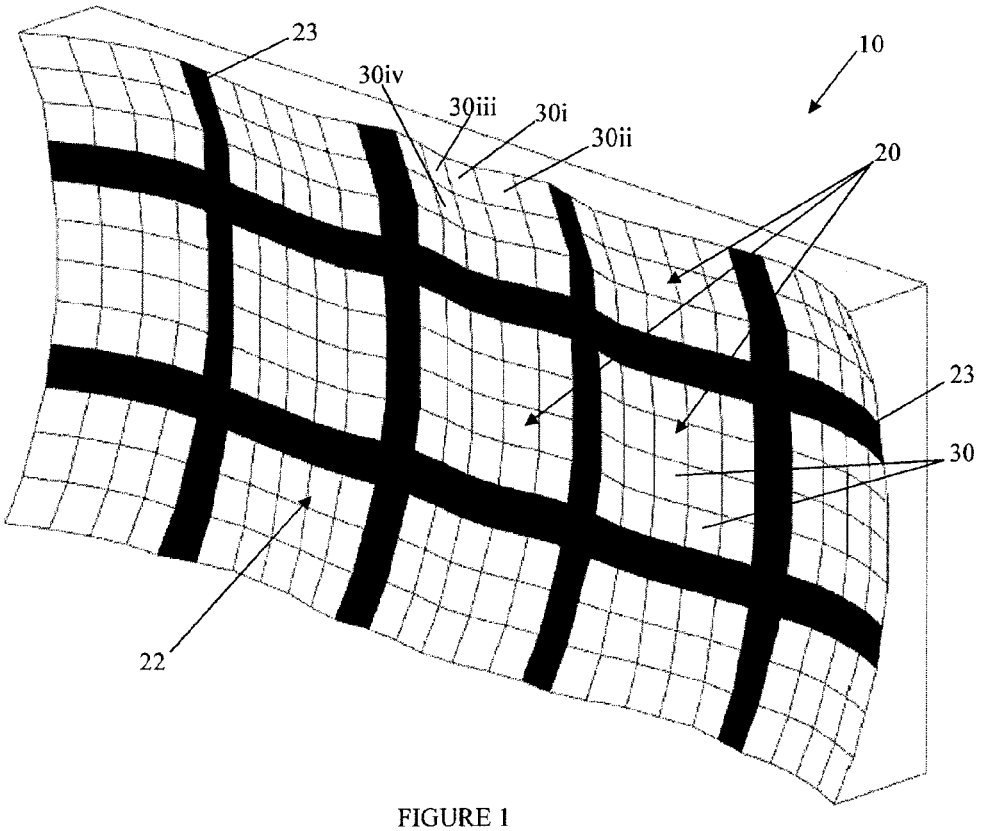
FIG. 1 is a perspective view of a rebound wall, in accordance with an embodiment.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the present invention may be used in sport, such as in tennis, for example, and as a result, is sometimes described in the context of its use with a tennis ball, a court and/or a tennis racquet, it is understood that it may be used with other playing devices, and in other sports and/or activities such as soccer or volleyball. Some of these racquets and their associated sports include, but are not limited to, squash racquets, racquetball racquets, jai alai, etc. For this reason, expressions such as "tennis", "tennis ball", "doubles", "net", "racquet", "fault", "court", etc. as used herein should not be taken as to limit the scope of the present invention to the sport of tennis in particular. These expressions encompass all other kinds of materials, objects and/or purposes with which the present invention could be used and may be useful.

In addition, although the optional configurations as illustrated in the accompanying drawings comprises various components and although the optional configurations of the rebound wall as shown may consist of certain geometrical configurations as explained and illustrated herein, not all of these components and geometries are essential to the invention and thus should not be taken in their restrictive sense, i.e. should not be taken as to limit the scope of the present invention. It is to be understood that other suitable components and cooperation thereinbetween, as well as other suitable geometrical configurations may be used for the rebound wall and corresponding parts, as briefly explained and as can be easily inferred herefrom, without departing from the scope of the invention.

List of alphanumerical references for some of the corresponding optional components illustrated in the accompanying drawings:

10. rebound wall (or simply "wall")
12. activity area
14. court
16. baseline
20. impact zone (or simply "zone")
22. continuous return surface
23. transitional band
24. center segment (of wall)
25. upper segment (of wall)
26. left segment (of wall)
27. lower segment (of wall)
28. right segment (of wall)
30. rebound face/region (or simply "face" or "region")
40. backstop Broadly described, the rebound wall described herein is an article which is intended to introduce an element of variety in the rebound of a ball directed against it, thereby reducing the predictability of volleys or shots against the wall, and advantageously helping to improve the skills of the player. The rebound wall mimics the play and/or skills of an opposing player, thereby more advantageously simulating the effect of playing against one or more people, all the while helping to keep the ball within a given area so as to advantageously minimize the time spent by the practicing player in chasing after the ball.

According to one aspect, there is provided a rebound wall 10 (or simply "wall"), an embodiment of which is provided in FIG. 1. The term "rebound" refers to the ability of the wall to return a ball which is hit against it. The term "wall" refers to a vertically-oriented construction, when installed, made of any suitable material, and having any suitable dimensions and configuration, which provides a surface against which a ball can be hit and returned. For example, the wall may be made of the same material used in climbing walls, which can be light, resistant to wear, textured, and easy to mold. It allows for on-site installation, configuration and replacement of wall components.

In one embodiment, the rebound wall is made of a composite material such as such as fiberglass, carbon fiber, Kevlar™ fiber, fiber-reinforced plastic, or the like. In another embodiment, the rebound wall may be made of wood such as plywood.

The wall is configured for varying a rebound of a ball directed against it. The term "configured" refers to the arrangement and organization of the wall and/or its components and/or the material(s) of which it is made, as further described below, which allow for a variation in the way the ball is returned from the wall.

The expression "varying a rebound" refers to the ability of the wall and/or its configuration to introduce an element of diversity or unpredictability in the manner by which the ball is returned by the wall, when compared to at least some of conventional flat or curved walls. As will become more apparent from the description below, such a level of diversity may be advantageously situated somewhere between complete randomness and repetitiveness. If the return of the ball from the wall were to be completely random, the wall would not accurately simulate the play of an opposing player, whose tendency is to return the ball according to generally known patterns. Furthermore, the player might become discouraged, and might become tired of chasing after a ball whose return patterns are illogical. Similarly, if the ball were to be always returned in the same manner (i.e. repetitiveness), the player would quickly become accustomed to the wall, and the practice value of hitting a ball against it would be greatly reduced if not eliminated altogether.

The wall is positioned with respect to a playing area or surface, such as a court, having an activity area for one or more players. The position of the wall with respect to the court may vary. For example, where the court is a tennis court, the wall can be positioned adjacent to the baseline of the court which is opposed to the player's own baseline. In another possible configuration, the wall can be positioned adjacent to the net and spanning its length, which may be suitable if the wall is installed in an area having space constraints. The term "court" is not limited to a tennis court, for example, and can include any other surface, field, yard, enclosure, or other play area, in which activities and/or sports of any kind can be practiced such as soccer.

The court has an activity area, as further described below. The activity area may be any area within the court in which the player is present when hitting the ball against the wall and/or where the ball is intended to be returned after impacting the wall. In the example where the court is a tennis court, the activity area can be any area which spans between the net and the baseline on one side of the court, and between the singles' side lines on the same side of the court. In the example where the court is a squash court, the activity area can span between the short line and the back of the squash court. The activity area is not limited to a particular width, length, or configuration, and may change depending on numerous factors such as the activity/sport being played, the available area, the ball being used, the material of the wall, and/or the like.

In one embodiment, the wall 10 comprises a plurality of contiguous impact zones 20, as illustrated in FIG. 1. The impact zones (or simply "zones") allow for varying the return of the ball after it impacts the wall, and help to mimic the play of an opposing player, irrespective of her/his skill level. In one embodiment, transitional bands 23 are located between adjacent impact zones 20 as illustrated in FIG. 1. In another embodiment, the rebound wall 10 comprises no transitional bands 23.

The zones 20 are contiguous. The term "contiguous" when used to describe the zones refers to the position of the zones along the surface of the wall. The position of the zones may be physically adjacent or neighboring, such that each zone is in contact with one or more zones located around it. Such an arrangement of zones along the wall extends horizontally between the side ends of the wall, and also vertically between the top and bottom ends of the wall, so as to cover the surface of the wall and form a continuous return surface 22. The expression "continuous return surface" refers to the ability of the zones to form a substantially constant and relatively seamless face, such that the ball does not impact a non-active or "dead" zone which does not allow for varying the return of the ball or an erratic zone which returns the ball substantially randomly or in a non-predictable manner. For example, such an erratic zone could be created by a protrusion or a recess formed in the wall. Such a protrusion or a recess would create substantially right-angled edges. When it hits an edge of such a protrusion or recess, the ball is returned in an erratic or non-predictable manner. Furthermore, the ball may also hit the wall twice before being returned. For example, the ball may hit the wall a first time and then hit a side face of a protrusion, thereby returning the ball in a direction opposite to the direction that the ball would have if it would be returned by a player.

In the continuous return surface 22, the zones 20 transition, blend, fade, etc. into one another with relative fluidity, thereby forming a more accurate representation of an opposing player.

In one embodiment, the relative fluidity of the transition between rebound face 30 may be obtained by having an angle θ between adjacent rebound plates that is comprised between about 135 degrees and about 225 degrees.

The expression "continuous return surface" can also refer to the appearance of the wall when observed, in that the wall can appear as a substantially homogenous surface, and can appear as wave-like or rippled, for example. In some optional embodiments, the homogenous surface can appear as a combination of planar and curved surfaces, each interacting with one another as a continuous return surface along various horizontal and vertical profiles. In one embodiment, the zones can be removed from the wall, advantageously facilitating replacement or repair of the zones and further allowing for the desired combination of zones to be chosen, and varied if desired.

In one embodiment, the rebound wall comprises a frame structure having a plate receiving face on which impact plates are removably secured. In one embodiment, each impact plate corresponds to a respective impact zone. In another embodiment, each impact plate corresponds to a respective rebound face.

Each impact zone 20 has multiple rebound faces 30, examples of which are shown in FIG. 1. The rebound faces 30 (or simply "faces") form the surface upon which the ball will hit before being returned. Their orientation, texture, configurations, material, and the like will affect how the ball will be returned to the activity area. While they appear to be planar in FIG. 1, it should be understood that at least some rebound faces 30 may be non-planar. For example, some rebound faces 30 may be curved, sloping, etc. Similarly, while they appear to have the same shape and dimensions in FIG. 1, it should be understood that the rebound faces 30 may have different shapes and dimensions.

The faces 30 rebound the ball along a rebound direction towards the activity area upon the ball impacting the faces. The expression "rebound direction", as further discussed below, refers to the course or line along which the ball is returned after impacting a face. The rebound direction can have any inclination or orientation provided that its path leads toward, but not necessarily into, the activity area. The rebound direction will depend upon numerous factors, such as the force at which the ball impacts a face 30, the texture/nature of the face 30, the orientation of the face 30, the type of ball being used, the angle at which the ball impacts a face, and/or the like. Indeed, in some embodiments, the faces can be covered and/or manufactured so as to dampen light reflectivity from their surface, thereby advantageously improving viewing of the faces. Further optionally, the faces 30 can be covered and/or manufactured so that their surfaces conserve the spin or rotation applied to the ball which impacts a face 30, such as topspin, thereby better imitating the play of an opposing player.

The expression "towards the activity area" refers to the ability of the faces 30 to return the ball near to the position at which the practicing player is located. The ball does not need be returned exactly to where the practicing player is located, but optionally, in the general vicinity of the practicing player. This functionality advantageously "keeps the ball in play", thereby increasing the number of consecutive shots exchanged between the practicing player and the wall so as to provide for longer rallies, and further advantageously helping the practicing player to avoid having to chase after errant balls, thus minimizing down time while practicing and helping maintain a certain intensity during practice.

Each face 30 is positioned, shaped, and sized such that the rebound direction of the ball impacting one face differs from the rebound direction of the ball impacting at least one other adjacent face. The expression "positioned, shaped, and sized" refers to the construction and orientation of each face 30, whose location within its zone 20 and whose orientation is specifically chosen so that the zone 20 in which it is found introduces unpredictability in the return of the ball while mimicking the play of an opposing player at that location of the wall.

While in FIG. 1 the faces 30 are each planar, it should be understood that at least some faces 30 may not be planar. In this case, at least some of the faces 30 may be curved. For example, the profile of a face 30 may present depressions or valleys and raised sections or lands. The curvature of the faces 30 may be smooth so that the faces 30 present no edges.

The rebound direction generated by each face 30 is different than the rebound direction generated by at least one, and optionally more, face 30 located adjacent thereto. Such adjacent faces 30 can be in the same zone, or in contiguous zones. For example, and in reference to FIG. 1, face 30*i* may generate a first rebound direction directed downward and toward the center of the activity area. Adjacent face 30*ii* may generate a second rebound direction which is different from that of face 30*i*, in that the rebound direction of face 30*ii* is directed downward but towards the right of the activity area. Similarly, the rebound direction of face 30*iii* and face 30*iv* would be different from that of face 30*i*. Therefore, the rebound direction of at least one adjacent face (in this case, faces 30*ii*, 30*iii*, and 30*iv*) is different from the rebound direction generated by face 30*i*, and vice versa. It can thus be appreciated that such a configuration of adjacent faces 30 advantageously introduces an element of variability into the return of the ball, and it is known that such variability can help a practicing player improve their play by better mimicking the play of an opposing player.

Having discussed some of the features and characteristics of the zones 20 and their faces 30, the cooperation of contiguous zones 20 and adjacent faces 30 will now be described in reference to FIGS. 1 to 12, such cooperation advantageously introducing variety into the return of the ball and forming a better representation of the play of an opposing player.

Figure 2:
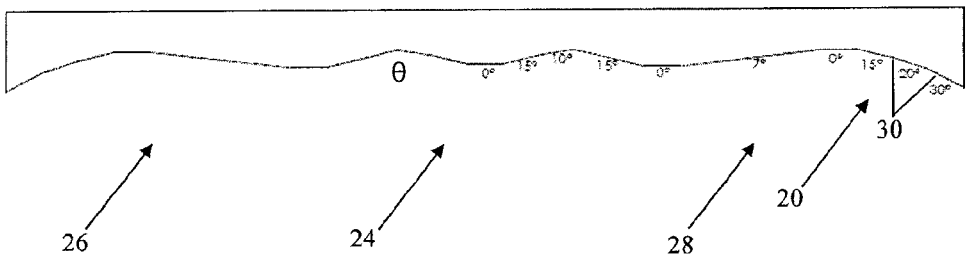
FIG. 2 is a top view of a rebound wall having a center segment, left segments, and right segments, in accordance with a first embodiment.
Figure 3:
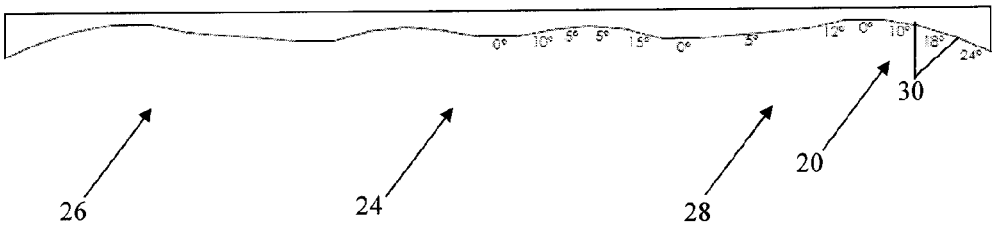
FIG. 3 is a top view of a rebound wall having a center segment, left segments, and right segments, in accordance with a second embodiment.

Referring to FIGS. 2 and 3, the zones can be arranged into a center segment, left segments, and right segments, 24, 26, and 28, respectively. The terms "center", "left", and "right" refer to segments of the wall when it is viewed from in front, such as by the practicing player. Each segment can include one or more zones 20, and each zone 20 can include one or more faces 30. Each segment can be adapted to mimic the play of a given skill level of players, the habits of a given player, or the typical returns of left-handed or right-handed players, to name but a few of the adaptations possible for each segment. The center, left, and right segments 24, 26, 28, respectively, will now be described in more detail.

Figure 4:
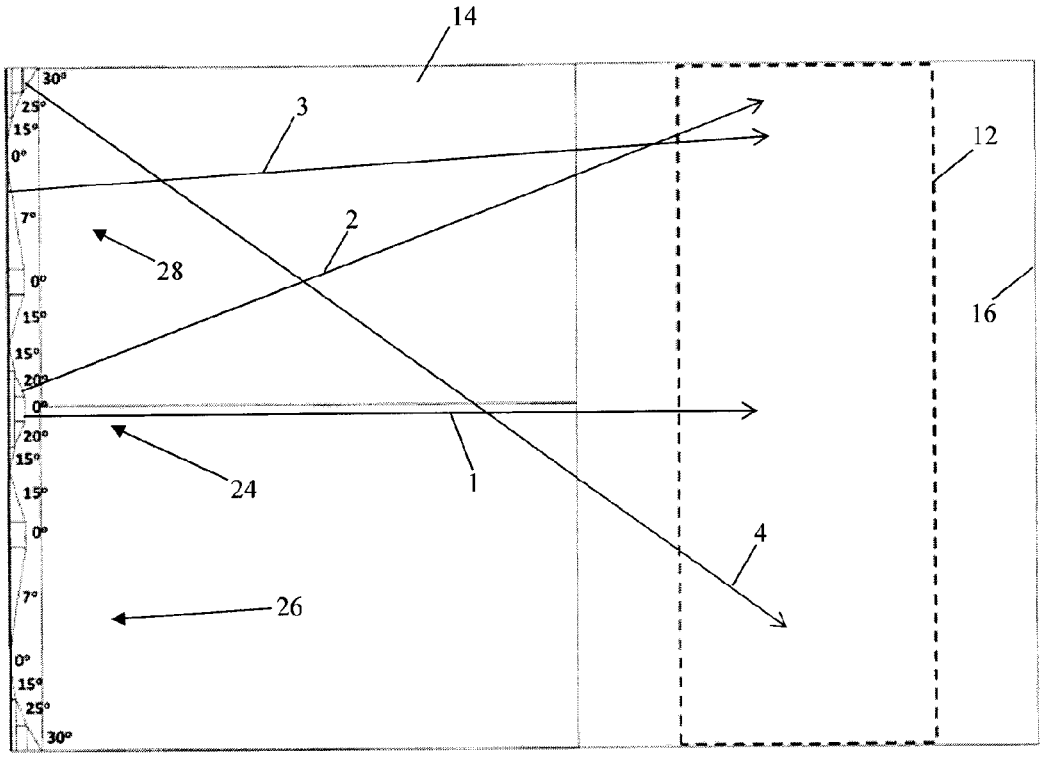
FIG. 4 is a top view of a playing surface provided with a rebound wall, in accordance with a first embodiment.

The center segment 24 may be configured so as to mimic the play of an opposing player, and introduce an element of variety in the manner by which the ball is returned along the width of the court. One possible embodiment of the center segment 24 which can achieve such functionality is shown in FIG. 4. The center segment 24 is positioned substantially in the middle of the wall. In this particular example, the center segment 24 comprises several impact zones 20 positioned vertically, and each impact zone 20 comprises multiple faces 30. The cooperation of its impact zones 20 and rebound faces 30 results in the ball being returned along multiple rebound directions towards any adequate part of the activity area. In one embodiment, such a configuration of the center segment 24 mimics the play of an opposing player who, if positioned on the court where the center segment 24 is located, would be able to hit the ball to any location within the court because such a location at center-court and/or center-baseline is a "strong" position.

For example, if the ball impacts a face 30 angled at 0° with respect to the baseline, it will be returned along rebound direction 1 as if it had hit a flat surface. Depending on the angle at which the ball impacts the 0° angled face, rebound direction 1 can vary greatly, which mimics the strong position of an opposing player who would also be able to return the ball from such a location. In one embodiment, the width of this face can be kept small so as to minimize the risk that the rebound direction 1 be directed away from the activity area. Similarly, if it impacts a face angled at 20° with respect to the baseline, the ball will be returned along rebound direction 2 as if it had hit an inclined surface. Rebound direction 2 reflects the new location of the opposing player, which although still strong, is slightly less strong since she/he is further away from center-court and/or center-baseline. Therefore, rebound direction 2 better mimics the slightly-more limited position of the opposing player, who in such a location may return the ball to the right side of the activity area. In one embodiment, the faces may also better imitate the play of left-handed and right-handed players, as well as the forehand and backhand returns.

The left and right segments 26 and 28 can be made to be symmetrical about the center segment, although they may be asymmetrical as well. In reference to the example provided in FIG. 4 or 5, and solely for the sake of brevity and clarity, only the right segment 28 will be described, and it should be understood that the left segment 26 could produce similar rebound directions, or varied ones, as desired.

Similarly to the center segment 24, the right segment 28 can be configured so as to mimic the play of an opposing player, and introduce an element of variety in the manner the ball is returned along the width of the court. The right segment 28 can occupy the length of the wall located between the center segment 24 and the right end of the wall. In the particular example of FIG. 4, the right segment 28 comprises two laterally adjacent impact zones 20 each comprising multiple faces 30. The cooperation of its impact zones 20 and rebound faces 30 results in the ball being returned along multiple rebound directions towards any adequate part of the activity area. In one embodiment, such a configuration of the right segment 28 mimics the play of an opposing player who, if positioned on the court at the location of the right segment 28, and particularly towards the extreme right of the court, would be able to hit the ball to a limited number of locations within the court because such a location at right side of the court is not the strongest position.

For example, if it impacts a face angled at 7° with respect to the baseline, the ball will be returned along rebound direction 3 as if it had hit an inclined surface. Depending on the angle at which the ball impacts the 7° angled face, the rebound direction 3 can vary but would generally be directed "down the line". Such a rebound direction mimics the typical return of an opposing player who, in such a relatively strong position, may wish to end a volley by blasting the ball down the sidelines. In one embodiment, the width of the 7° angled face can be made slightly larger than adjacent faces, reflecting the increased variability of rebound directions hitting this face. Similarly, if it impacts a face angled at 30° with respect to the baseline, the ball will be returned along rebound direction 4 as if it had hit an inclined surface. Rebound direction 4 reflects the new location of the opposing player, which is relatively weak because she/he is at the extreme right and furthest away from center-court. Therefore, the rebound direction 4 better mimics the disadvantaged position of the opposing player, who in such a location, will typically attempt to return the ball to the center of the activity area.

Figure 5:
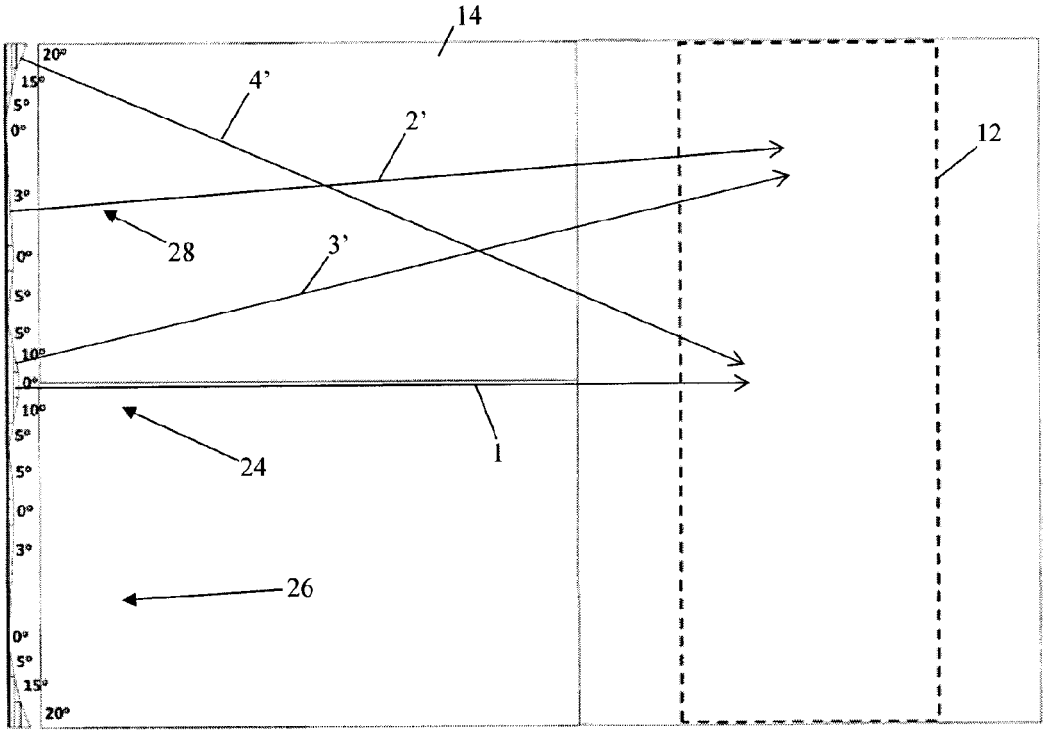
FIG. 5 is a top view of a playing surface provided with a rebound wall, in accordance with a second embodiment.
Figure 8:
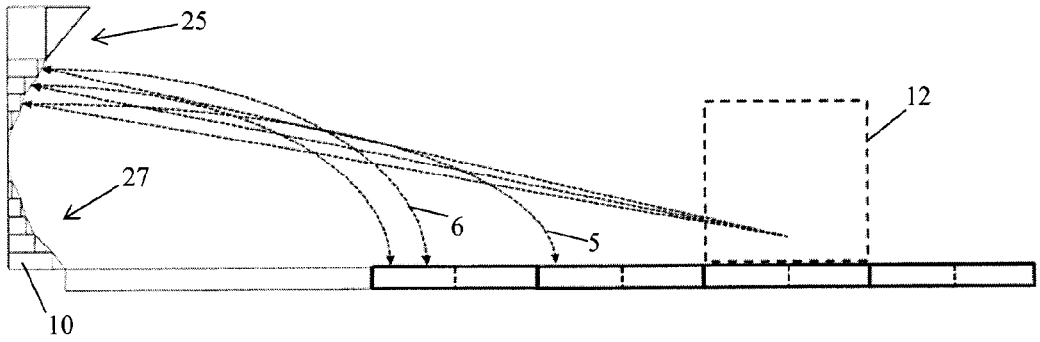
FIG. 8 illustrates rebound angles for a ball impacting a rebound wall, in accordance with a first embodiment.

FIG. 5 shows center, left, and right segments 24, 26, and 28 of the wall as well. The zones 20 and/or faces 30 of the segments 24, 26, and 28 may have orientations or inclinations which are less "sharp" or pronounced, so as to introduce slightly less aggressive rebounds or more predictability into the rebound directions generated, as illustrated by rebound directions 2', 3', and 4' with respect to rebound directions 2, 3, and 4, respectively. Such a wall may advantageously be suitable for practicing players having low or medium skill levels. It can thus be appreciated that the combination of segments 24, 26, and 28, zones 20 and/or faces 30 can be adapted to suit the skill level of any practicing player. FIG. 8 provides a frontal view of an embodiment of the wall, with examples of possible angles for its faces 30 being shown.

Figure 6:
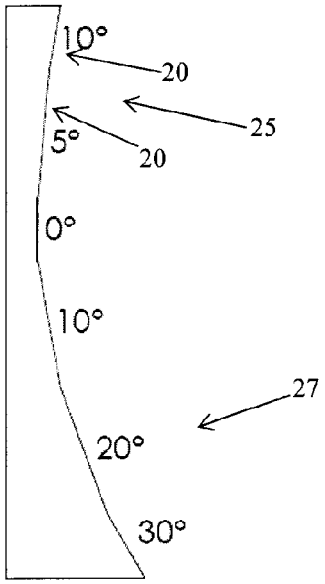
FIG. 6 is a side view of a rebound wall, in accordance with a first embodiment.
Figure 7:
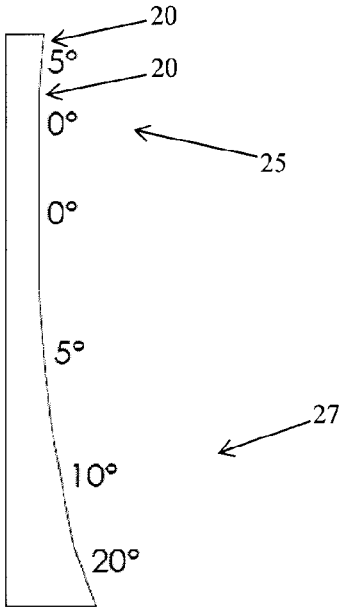
FIG. 7 is a side view of a rebound wall, in accordance with a second embodiment.

Referring to FIGS. 6 and 7, the zones 20 can be arranged into upper segments 25 and lower segments 27. The terms "upper" and "lower" refer to top and bottom segments of the wall when it is viewed from in front, such as by the practicing player. Each segment 25, 27 can include one or more zones 20, and each zone 20 can include one or more faces 30. In some optional embodiments, any of the segments may be separated by a transitional band 23, an example of which is shown in FIG. 1. Such a transitional band 23 can form a smooth change or link between adjacent segments, zones and/or faces, with different horizontal and vertical profiles, thereby further advantageously contributing to the continuous return surface. The upper and lower segments 25 and 27 will now be described in more detail.

As with the other segments described above, the upper segment 25 can also be configured so as to mimic the play of an opposing player, and introduce an element of variability in the manner the ball is returned along the vertical direction. One possible embodiment of the upper segment 25 which may achieve such functionality is shown in FIG. 8. The upper segment 25 is positioned roughly at the top of the wall. In this particular example, the upper segment has one impact zone having multiple rebound faces. The cooperation of its impact zones and rebound faces result in the ball being returned along multiple rebound directions spanning the height and length of the activity area 12. In one embodiment, such a configuration of the upper segment 25 mimics the play of an opposing player who, if returning a shot from this upper location, would typically be able to smash the ball along any vertical rebound direction because such a location is a strong position.

For example, if it impacts the face angled at 5° with respect to a vertical axis, the ball will be returned along rebound direction 5 as if it had hit an inclined surface. Depending on the angle at which the ball impacts the 5° angled face, the rebound direction 5 may vary but will generally follow a downward path, which mimics the strong position of an opposing player returning a ball from this position. In one embodiment, the height of the 5° angled face may be made slightly greater than that of adjacent faces, reflecting the increased variability of vertically-directed rebound directions hitting the 5° angled face. Similarly, if it impacts the face angled at 10° with respect to the vertical axis, the ball will be returned according to rebound direction 6 as if it had hit an inclined surface. The rebound direction 6 reflects the new location of the opposing player and/or her/his racquet, which is stronger still than with rebound direction 5, in that the opposing player can apply the full amplitude of her/his swing so as to generate a smash. Therefore, the rebound direction 6 better mimics, with respect direction 5, the power position of the opposing player, who in such a location, may smash the ball toward any location within the activity area.

Figure 9:
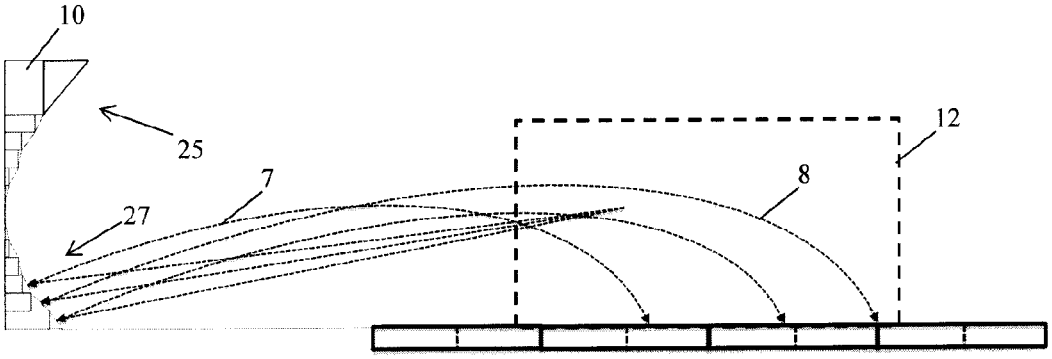
FIG. 9 illustrates rebound angles for a ball impacting a rebound wall, in accordance with a second embodiment

As with the other segments described above, the lower segment 27 can also be configured so as to mimic the play of an opposing player, and introduce an element of variety in the manner by which the ball is returned along the vertical direction, as illustrated in FIG. 9. The lower segment can be positioned roughly at the bottom half of the wall. In this particular example, the lower segment has two impact zones having multiple rebound faces. The cooperation of its impact zones and rebound faces results in the ball being returned along multiple rebound directions spanning the height of the activity area. Such a configuration of the lower segment advantageously mimics the play of an opposing player who, if returning a shot from this lower location, would typically lob or volley the ball along any vertical rebound direction For example, if it impacts the face angled at 10° with respect to a vertical, the ball will be returned along rebound a first direction 7 as if it had hit an inclined surface. Depending on the angle at which the ball impacts the 10° angled face, the rebound direction 7 may vary but will generally follow an upward path, which mimics the relatively strong position of an opposing player returning a ball from this position, who may wish to push the ball to the back of the court. In one embodiment, the height of the 10° angled face may be made slightly larger than adjacent faces, reflecting the increased variability of vertically-directed rebound directions generated by this face. Similarly, if it impacts the face angled at 30° with respect to the vertical, the ball will be returned along a second rebound direction 8 as if it had hit an inclined surface. The second rebound direction reflects the new location of the opposing player and/or her/his racquet, which is weaker than with the first rebound direction 7, in that the second rebound direction 8 reflects the return of an opposing player who is struggling to return a shot and get back into position by lobbing the ball deep into the backcourt of the activity area. Therefore, the second rebound direction 8 better mimics the weakest position of the opposing player.

Figure 10:
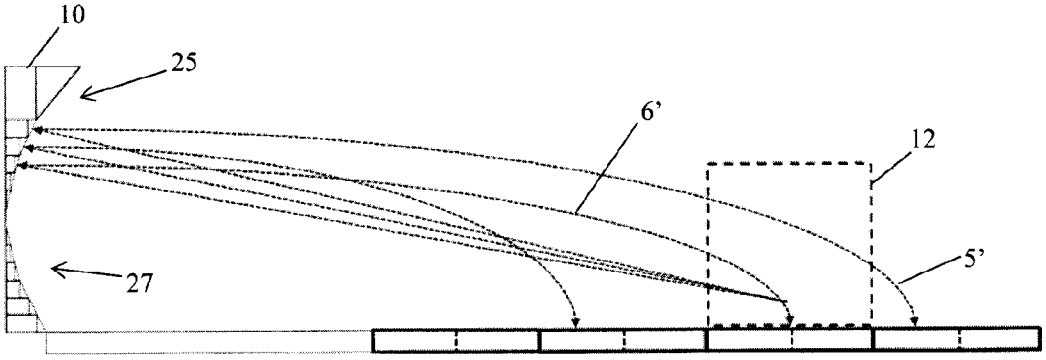
FIG. 10 illustrates rebound angles for a ball impacting a rebound wall, in accordance with a third embodiment.

FIG. 10 provides an example of an alternative embodiment of upper and lower segments 25 and 27 of the wall. The zones 20 and/or faces 30 of these segments 25 and 27 may have vertical orientations or inclinations which are less "sharp" or pronounced, so as to introduce slightly more predictability into the vertical rebound directions generated, as illustrated by rebound directions 5' and 6' with respect to rebound directions 5 and 6, respectively. Such a wall may be suitable for practicing players having low or medium skill levels. As mentioned above, it can thus be appreciated that the combination of segments, zones and/or faces can be advantageously adapted to suit the skill level of any practicing player.

In light of the above explanations, it can thus be appreciated that the combination of segments, zones and/or faces, in both the vertical or horizontal directions of the wall, may introduce variability and variety in the manner the wall returns the ball, while allowing to logically imitate the play of an opposing player who returns the ball along both the width and length of the court. Indeed, one example of a wall incorporating the features and characteristics described above is provided in FIG. 11. The wall illustrated in FIG. 11 comprises a plurality of impact zones 20 and each impact zone 20 comprises at least one rebound face 30. Each zone 20 is designed to correspond to a respective desired type of shot, i.e. a zone 20 is sized and/or shaped to rebound the ball according to a respective shot that a player would normally do. For example, the orientation and/or profile of the front surface of the face(s) 30 (i.e. the surface of the face 30 that faces the player) that are comprised in the zone 20 may be adequately adjusted to provide the respective shot when the ball hits the zone 20. For example, when the wall is adapted to play tennis, each zone 20 may be designed to correspond to one of the following shots: a serve, a forehand shot, a backhand shot, a groundstroke, a volley, a swing, a drop volley, a drive volley, a flat shot, a topspin, a backspin, a smash, a drop shot, a lob, a moon volley, a passing shot, a down-the-line shot, or the like. In another example in which the wall is adapted to play soccer, each zone 20 may be designed to correspond to one of the following shots: an instep drive, a swerve shot, a chip shot or a lob, a knuckleball, or the like.

As can be seen, and as can be better appreciated in light of the above description, a ball directed to the impact zone entitled "Drop Shot" may be configured to produce rebound directions following paths directed toward the right and center of the activity area, and generally oriented downwardly. Similarly, the impact zone entitled "Passing Shot" may be configured to produce rebound directions following paths directed toward the left and center of the activity area, and generally oriented upwardly. Similarly, the impact zone entitled "Volley" may be configured to produce rebound directions following paths directed horizontally anywhere between the left and right extremes of the activity area, and generally oriented either upwardly or vertically, thereby reflecting the strong position of the opposing player.

Figure 11:
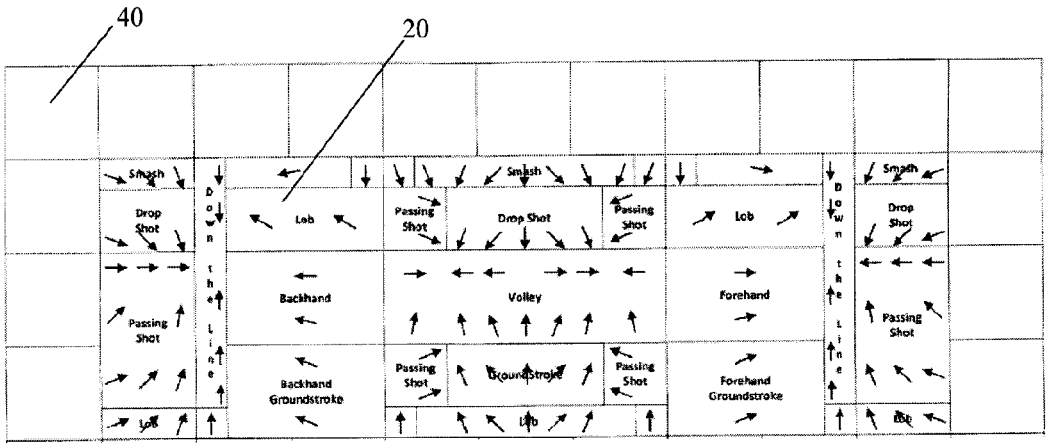
FIG. 11 is a front view of a rebound wall having multiple impact zones each associated with a respective type of shot, in accordance with an embodiment.

The wall may also have one or more backstops, examples of which are provided in FIG. 11. The backstops are configured to deaden or dampen the rebound of the wall when the practicing player's shot is hit in a direction that is out of bounds. As such, that backstops can be made of any suitable material including foam, netting, wood, etc. Further optionally, the backstops can be curved or angled toward the activity area so as to return any ball hit thereagainst toward the player within the activity area. The backstops may consist of a band which surrounds either the entirety of, or only a portion of the wall. In one embodiment, the band may have a width of about 3 feet. In another embodiment, the backstops may consist of a cavity or other similar device used to collect the balls hit therein. In one embodiment, the backstops may be provided with an impact sensor for detecting when a ball hits a backstop and an audio signal generator for emitting an audio signal when the ball impacts so as to alert the practicing player that their shot would likely have landed out of bounds.

Figure 12:
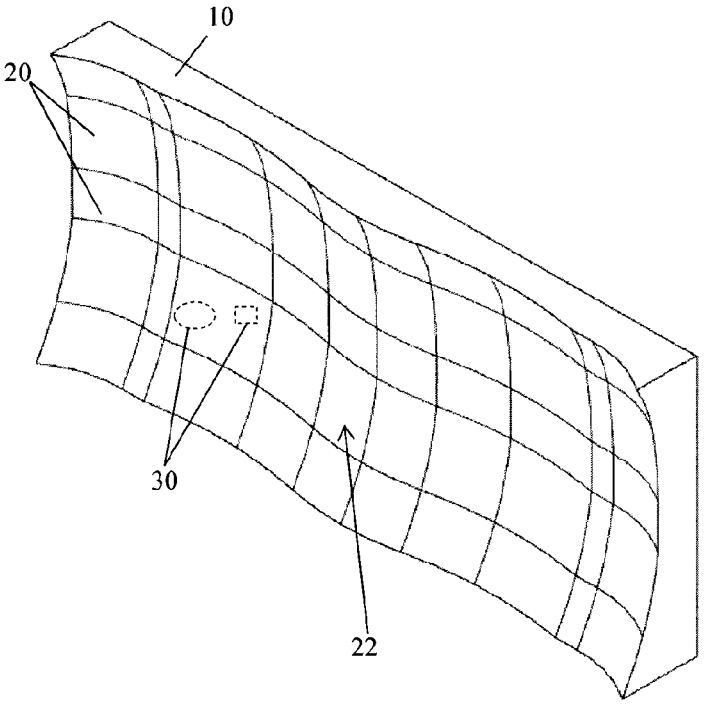
FIG. 12 is a perspective view of a rebound wall having multiple impact zones each associated with a respective type of shot, in accordance with an embodiment.

In one embodiment, the rebound comprises a wall having a continuous rebound surface as illustrated in FIG. 12. The wall is adapted to be positioned vertically relative to the playing surface or area so that the rebound surface substantially faces an activity area of the playing area. For example, the rebound wall may be positioned outside but adjacent to the playing area. In another example, the rebound wall may be positioned on the playing area.

The rebound surface comprises a plurality of impact zones 20 each for returning the ball according to a respective type of shot. Each impact zone comprises at least one rebound region 30 each for rebounding the ball along a respective rebound direction towards the activity area upon the ball impacting thereon. Each rebound region is designed, i.e. shaped and/or sized, as a function of its respective rebound direction and the type of shot of the impact zone in which it is contained. In one embodiment, the rebound regions each correspond to a respective rebound face 30 described above.

In one embodiment, the type of shot for each impact zone is chosen as a function of the position of the impact zone within the rebound surface. For example and referring back to FIG. 11, the top right impact zone is designed for returning a smash shot while the right bottom impact zone is designed to return a lob shot.

In one embodiment, the rebound regions comprise at least one planar region.

In the same or another embodiment, the rebound regions comprise at least one curved region. A curved region may comprise at least one valley and/or at least one land.

In still another embodiment or the same embodiment, the rebound regions may comprise at least one sloping region.

In one embodiment, the rebound surface is designed for rebounding a tennis ball. In this case, the each impact zone is designed so as to return the ball according to a respective type of shot. The types of shot may comprise: a serve, a forehand shot, a backhand shot, a groundstroke, a volley, a swing, a drop volley, a drive volley, a flat shot, a topspin, a backspin, a smash, a drop shot, a lob, a moon volley, a passing shot, a down-the-line shot, and/or the like.

In another embodiment, the rebound surface is designed for rebounding a soccer ball. In this case, the types of shot may comprise: an instep drive, a swerve shot, a chip shot or a lob, a knuckleball, and/or the like.

Figure 13:
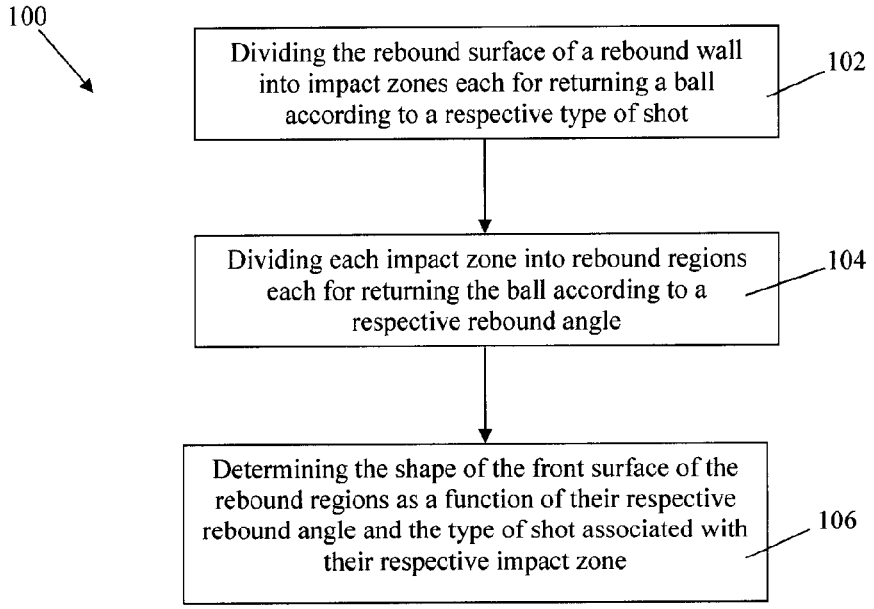
FIG. 13 is a flow chart illustrating a method of designing the rebound surface of a rebound wall, in accordance with an embodiment.

FIG. 13 illustrates one embodiment of a method 100 for designing a rebound wall adapted to be positioned relative to a playing surface having an activity area and configured for varying a rebound of a ball directed thereon. The first step 102 consists in dividing the rebound surface of the rebound wall into a plurality of impact zones. Each impact zone is intended to return the ball according a respective type of shot. The size and/or shape of the impact zones may vary from one another. In one embodiment, for each given impact zone, the type of shot is chosen as a function of the usual type of shot that a player would normally do if he would play the ball at the location of the given impact zone.

At step 104, each impact zone is divided into at least one rebound region and each region is associated with a respective rebound direction/angle for rebounding the ball therealong towards the activity area of the playing surface. It should be understood that the size of the rebound regions may vary from one another. For example, all of the rebound regions contained in a same impact zone may have the same shape that is different from the size of the rebound regions contained in other impact zones. In another example, the rebound regions contained in a same impact zone may have different sizes.

In one embodiment, the rebound direction is chosen to correspond to the usual direction that a player would give to the ball if he would play the ball at the location of the rebound region. Therefore, the rebound direction is chosen as a function of the location of the rebound region within the wall.

At step 106, the shape of the front surface of each rebound region is determined as a function of the rebound direction for the rebound region and the type of shot associated with the impact zone in which the rebound region is contained.

In one embodiment, for a rebound wall having substantially the same dimensions, increasing the number of impact zones increases the level of difficulty for a player playing against the rebound wall. Since the number of impact zones increases, the unpredictability for the balls returns increases since the number of different possible shots increases, and the level of difficulty increases too. Similarly, increasing the number of rebound regions within the impact zones increases the level of difficulty since the number of possible rebound directions increases.

In one embodiment, the rebound direction for the rebound regions is further chosen as a function of a desired skill level. As described above, the rebound angles may be greater for a wall mimicking a player having an advanced skill level than for the rebound angles for a wall mimicking a player having an intermediate skill level.

In one embodiment, the material of which each rebound region is made is chosen as function of the type of shot associated with the rebound region. For example, the hardness of the material of which the rebound regions is made may be varies from one impact zone to another. When a smash shot is associated with a given impact zone, the rebound regions contained in this impact zone may be made of a material that is harder than the material of which rebound regions associated with a smash shot are made. It should be understood that the rebound surface of the wall may be made of the same material and a coating may be deposited on given rebound regions of the rebound surface in order to vary their hardness.

In one embodiment, the wall designed using the method 100 presents some unpredictability since the type of returned shot and the rebound direction vary from one of the rebound surface to another. However, since the rebound directions are chosen so as to return the ball towards the activity zone in which the player is located, the player may still play the returned ball. This ensures that there will be substantially no erratic ball returned by the wall according to a type of shot and/or rebound direction that would be contrary to what a normal player would do. Therefore, the wall presents an intelligence of play that substantially corresponds to the intelligence of play of a real player. The intelligence of play for the rebound wall may be varied by varying the number of impact zones, the number of rebound regions within the impact zones, the material of which the rebound regions are made of, the rebound directions for the rebound regions, the dimensions of the impact zones and/or the rebound regions, the location of the impact zones and/or the rebound regions within the rebound surface 22, and/or the like. For example, the intelligence of play for the rebound wall may correspond to the intelligence of play of a beginner player. In another example, the rebound wall may be designed so that its intelligence of play corresponds to that of an expert player. In one embodiment, the dimensions of the rebound wall are chosen as a function of at least one dimension of the playing area. The dimensions of the rebound wall may further be chosen as a function of the location of the rebound wall relative to the playing area. For example, a rebound wall for tennis that is intended to be positioned adjacent to the net may have a width substantially equal than that of the tennis court. In another example, a rebound wall for tennis that is intended to be positioned adjacent the baseline of a tennis court may have a width greater than that of the tennis court.

In one embodiment, it can be appreciated that the wall represents an improvement over at least some conventional walls in that, by virtue of its design and components, the wall may introduce a suitable level of variety, variability, and/or unpredictability in the return of the ball hit thereon, while simultaneously simulating the play of an opposing player of any skill level and keeping the ball in play. In one embodiment, when compared to some flat walls, the wall disclosed herein is a substantial improvement in that it overcomes the problems associated with such flat walls, namely, the predictability associated with the return of the ball and the inability to keep the ball in play. In one embodiment, the continuous return surface, which can have combination of surfaces transitioning smoothly to curved surfaces, can more advantageously imitate the play of an opposing player while avoiding any joints, junctions, or points which might introduce an errant rebound of the ball.

In one embodiment, the continuous return surface formed by the impact zones may ensure a level of fluidity between the impact zones, thereby allowing the ball to continue to be returned with variety while imitating the play of an opposing player at all points on the wall. This is in contrast to discrete and separated return zones found some conventional walls.

In one embodiment, the use of the wall can be a good training complement. Similarly, the wall can allow a single player to improve her/his game by simulating substantially real, game-like conditions, while permitting her/him to learn at her/his own pace. The wall can be adapted for two people, such as in a doubles setting.

The embodiments of the invention described above are intended to be exemplary only. The scope of the invention is therefore intended to be limited solely by the scope of the appended claims.

I claim:

1. A rebound wall to be positioned with respect to a playing surface having an activity area and configured for varying a rebound of a ball directed thereon, the rebound wall comprising:

a wall having a rebound surface and adapted to be positioned vertically relative to the playing surface so that the rebound surface faces the activity area, the rebound surface comprising a plurality of impact zones each for returning the ball according to a predetermined type of shot and a plurality of transitional bands each forming a smooth change that links adjacent ones of the plurality of impact zones to provide a fluid transition between the adjacent ones of the plurality of impact zones and to provide a continuous return surface defining the rebound surface, each impact zone comprising a plurality of rebound regions each for rebounding the ball along a predetermined rebound direction towards the activity area upon the ball impacting thereon, each one of the plurality of rebound regions being sized and shaped to provide the predetermined rebound direction and type of shot of the respective impact zone in which the rebound region is contained;

wherein the continuous return surface is free of pointed protrusions to avoid an errant rebound of the ball, wherein adjacent ones of the plurality of rebound regions have at least one of different shapes and different orientations along the entire rebound wall, and wherein adjacent ones of the plurality of rebound regions within each one of the plurality of impact zones are in contact together.

2. The rebound wall of claim 1, wherein the type of shot for each impact zone is chosen as a function of the position of the impact zone within the rebound surface.

3. The rebound wall of claim 1, wherein the plurality of rebound regions comprises at least one planar region.

4. The rebound wall of claim 1, wherein the plurality of rebound regions comprises at least one curved region each comprising at least one of a valley and a land.

5. The rebound wall of claim 1, further comprising at least one backstop positioned adjacent to the wall.

6. The rebound wall of claim 1, wherein the rebound surface is designed for rebounding a tennis ball.

7. The rebound wall of claim 6, wherein the predetermined type of shot comprises one of: a serve, a forehand shot, a backhand shot, a groundstroke, a volley, a swing, a drop volley, a drive volley, a flat shot, a topspin, a backspin, a smash, a drop shot, a lob, a moon volley, a passing shot, and a down-the-line shot.

8. The rebound wall of claim 1, wherein the rebound surface is configured for rebounding a soccer ball.

9. The rebound wall of claim 8, wherein the predetermined type of shot comprises one of: an instep drive, a swerve shot, a chip shot or a lob, and a knuckleball.

10. The rebound wall of claim 1, wherein the continuous return surface defines the entire rebound surface including the plurality of impact zones.

11. The rebound wall of claim 1, wherein the plurality of impact zones are contiguous with one another and together define the continuous return surface, and wherein the continuous return surface forms a constant and seamless face to define fluid transitions between the plurality of impact zones.

12. A rebound wall to be positioned with respect to a court having an activity area and configured for varying a rebound of a ball directed thereon, the rebound wall comprising:

a plurality of contiguous impact zones dispersed horizontally between opposed side ends of the rebound wall and vertically between a top end and a bottom end of the rebound wall, thereby forming a continuous return surface, each impact zone comprising a plurality of rebound regions defining the continuous return surface, each rebound region configured to rebound the ball along a predetermined rebound direction towards the activity area upon the ball impacting the rebound region, each one of the plurality of rebound regions being positioned, shaped, and sized such that the predetermined rebound direction of the ball impacting thereon differs from the rebound direction of the ball impacting at least one adjacent one of the plurality of rebound regions; and a plurality of transitional bands each forming a smooth change that links adjacent ones of the plurality of impact zones defining the plurality of rebound regions to provide a fluid transition between the adjacent ones of the plurality of impact zones and to provide the continuous return surface;

wherein the continuous return surface is free of pointed protrusions to avoid an errant rebound of the ball, wherein adjacent ones of the plurality of rebound regions have at least one of different shapes and different orientations along the entire rebound wall, and wherein adjacent ones of the plurality of rebound regions within each one of the plurality of impact zones are in contact together.

13. The rebound wall of claim 12, comprising upper segments and lower segments, the impact zones of the upper segments being configured for rebounding the ball in a downward rebound direction, and the impact zones of the lower segments being configured for rebounding the ball in an upward rebound direction.

14. The rebound wall of claim 12, comprising a center segment, left segments, and right segments, the impact zones of the center segment configured for rebounding the ball towards the activity area along any rebound direction, the impact zones of the left and right segments configured for rebounding the ball towards the activity area.

15. The rebound wall of claim 12, wherein at least some of the plurality of rebound regions are planar.

16. The rebound wall of claim 12, wherein at least some of the plurality of rebound regions are curved.

17. The rebound wall of claim 12, further comprising at least one backstop positioned adjacent to the continuous return surface.

18. The rebound wall of claim 12, wherein the continuous return surface defines the entire rebound wall including the plurality of contiguous impact zones.

19. The rebound wall of claim 12, wherein the plurality of contiguous impact zones together define the continuous return surface, and wherein the continuous return surface forms a constant and seamless face to define fluid transitions between the plurality of contiguous impact zones.

* * * * *